US008181285B1

(12) United States Patent
Jackson

(10) Patent No.: US 8,181,285 B1
(45) Date of Patent: May 22, 2012

(54) SHOWER/BATH SEAT ASSEMBLY

(76) Inventor: Rhonda G. Jackson, Temple Terrace, FL (US)

( * ) Notice: Subject to any disclaimer, the term of this patent is extended or adjusted under 35 U.S.C. 154(b) by 347 days.

(21) Appl. No.: 12/386,050

(22) Filed: Apr. 13, 2009

(51) Int. Cl.
*A47K 3/022* (2006.01)

(52) U.S. Cl. ..... 4/578.1; 4/583; 4/571.1; 4/573.1; 297/16.1; 297/17

(58) Field of Classification Search ..... 4/583, 571.1, 4/573.1, 578.1; 297/16.1, 17; 70/59, 27
See application file for complete search history.

(56) References Cited

U.S. PATENT DOCUMENTS 3,385,631 A * 5/1968 Gertler ..... 297/111
4,359,791 A 11/1982 Thomas
5,335,377 A * 8/1994 Masyada et al. ..... 4/578.1
5,606,751 A 3/1997 Baker
6,039,403 A 3/2000 Hargroder
6,256,806 B1 * 7/2001 DiTommaso ..... 4/560.1
6,305,741 B1 * 10/2001 Fernandez ..... 297/14
6,615,420 B1 * 9/2003 Hyden et al. ..... 4/579

* cited by examiner

*Primary Examiner* — Jason Boeckmann
*Assistant Examiner* — Joel Zhou

(57) ABSTRACT

A seat assembly includes primary and secondary sections. Each section has a primary face and a secondary face. Each face has a peripheral side wall, interior and exterior edges, and front and rear edges. A hinge couples the side walls of the sections at the interior edges. In this manner movement between deployed and collapsed orientations is allowed. Four primary legs are pivotally secured to the primary face between its peripheral side wall. Two secondary legs are pivotally secured to the secondary face adjacent to its exterior edge between its peripheral side wall. The legs are pivotable between the collapsed and deployed orientations perpendicular to the primary and exterior faces. Holes are provided in the peripheral side walls adjacent to the exterior edges. A handle has legs reciprocally received within the holes. The handle has a grip. The grip couples the legs for carrying purposes.

1 Claim, 4 Drawing Sheets

FIG 3
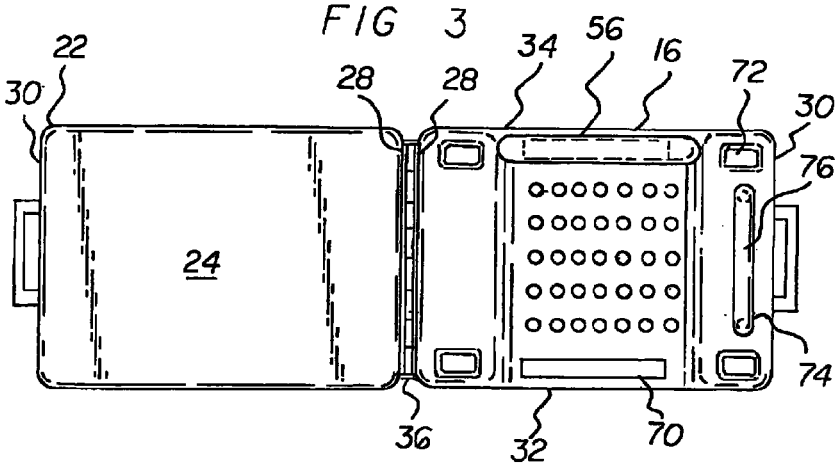
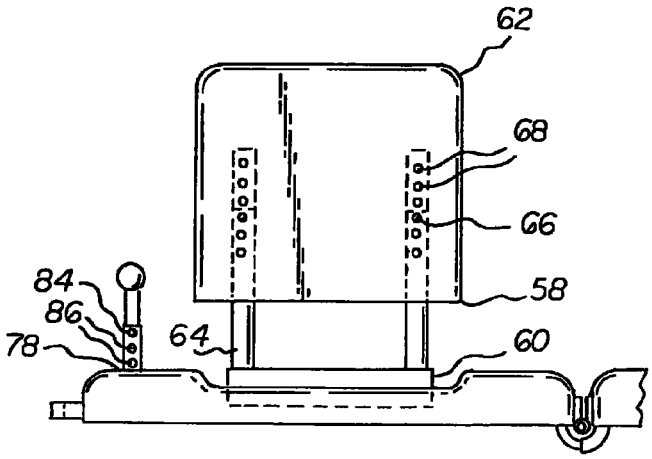
FIG 4

FIG 5
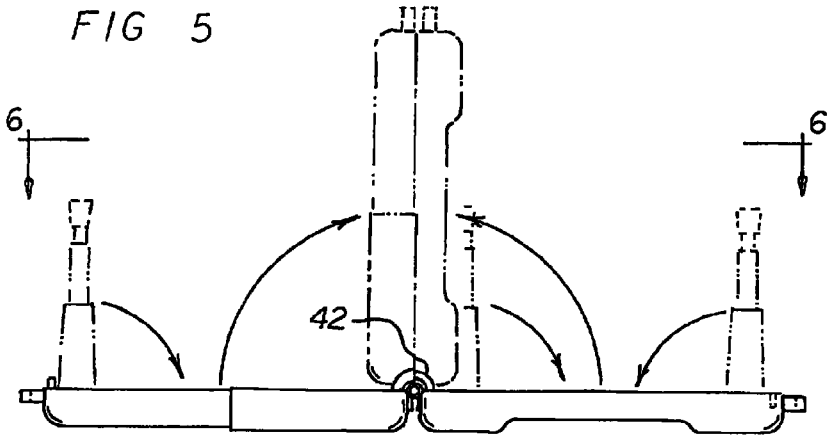
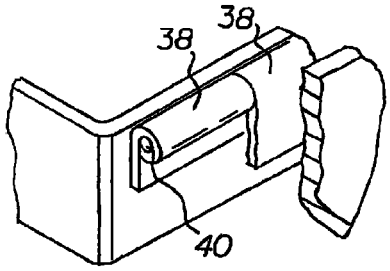
FIG 5A
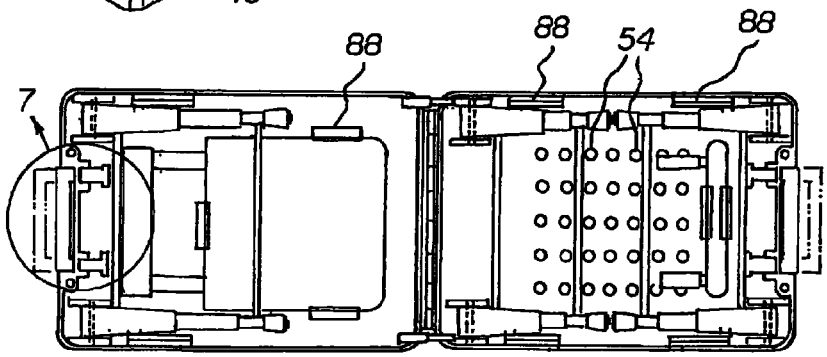
FIG 6

FIG 7
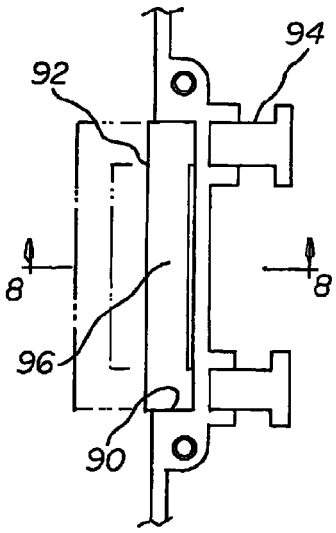
FIG 8
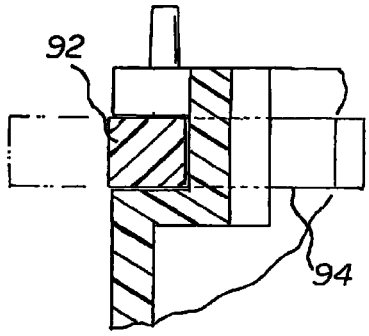
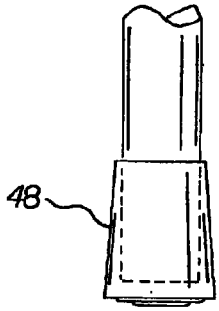
FIG 9
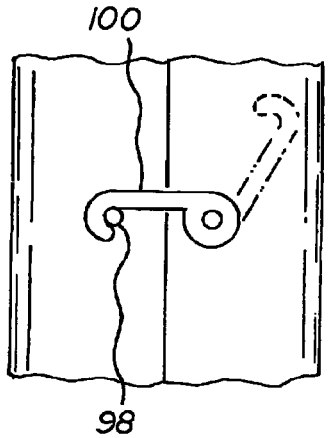
FIG 10

SHOWER/BATH SEAT ASSEMBLY

BACKGROUND OF THE INVENTION

1. Field of the Invention

The present invention relates to a shower/bath seat assembly and more particularly pertains to converting between a deployed orientation for use and a collapsed orientation for storage, the converting being done in a safe, convenient and economical manner.

2. Description of the Prior Art

The use of shower support systems of known designs and configurations is known in the prior art. More specifically, shower support systems of known designs and configurations previously devised and utilized for the purpose of supporting a user while showering through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,039,403 issued Mar. 21, 2000 to Hargroder relates to a Shower/Tub Transfer Chair. U.S. Pat. No. 5,606,751 issued Mar. 4, 1997 to Baker relates to Shower Chair and Bathtub Transfer Assembly. Lastly, U.S. Pat. No. 4,259,791 issued Nov. 23, 1982 to Thomas relates to a Folding Transfer Bench with Improved Roller and Arm Assembly.

While these devices fulfill their respective, particular objectives and requirements, the aforementioned patents do not describe a Shower/bath seat assembly that allows for converting between a deployed orientation for use and a collapsed orientation for storage, the converting being done in a safe, convenient and economical manner.

In this respect, the Shower/bath seat assembly according to the present invention substantially departs from the conventional concepts and designs of the prior art, and in doing so provides an apparatus primarily developed for the purpose of converting between a deployed orientation for use and a collapsed orientation for storage, the converting being done in a safe, convenient and economical manner.

Therefore, it can be appreciated that there exists a continuing need for a new and improved Shower/bath seat assembly which can be used for converting between a deployed orientation for use and a collapsed orientation for storage, the converting being done in a safe, convenient and economical manner. In this regard, the present invention substantially fulfills this need.

SUMMARY OF THE INVENTION

In view of the foregoing disadvantages inherent in the known types of shower support systems of known designs and configurations now present in the prior art, the present invention provides an improved Shower/bath seat assembly. As such, the general purpose of the present invention, which will be described subsequently in greater detail, is to provide a new and improved Shower/bath seat assembly and method which has all the advantages of the prior art and none of the disadvantages.

To attain this, the present invention essentially comprises a Shower/bath seat assembly. First provided is a seat assembly. The seat assembly includes a generally rectilinear primary section. The primary section has a primary face. The primary section has a primary peripheral side wall. The seat assembly also includes a generally rectilinear secondary section. The secondary section has a secondary face. The secondary section has a secondary peripheral side wall. The secondary face and the secondary side wall are adapted to telescopically stretch and reduce in size. The primary and secondary faces each have an inner surface and an outer surface. Each primary and secondary face is rectangular. Each primary and secondary face has four corners. Each primary and secondary face has interior edges. Each primary and secondary face has exterior edges. Each primary and secondary face has front edges. Each primary and secondary face also has rear edges. The seat assembly includes a linear hinge. The linear hinge couples the primary and secondary side walls at the interior edges. In this manner movement is allowed between the deployed orientation and the collapsed orientation. In the deployed orientation the primary and secondary faces are in an essentially common plane. In the collapsed orientation the primary and secondary faces are in a spaced relationship and the peripheral side walls are in facing contact. In this manner a chamber is formed between the primary and secondary faces. The hinge has P-shaped sections. The P-shaped sections are secured to one of the primary or secondary peripheral side walls. The seat assembly also includes a linear rod. The linear rod pivotally supports the P-shaped sections. The hinge is restricted to a 90 degree open position. In this manner the primary and secondary faces are in an essentially common plane. The seat assembly further includes arcuate tubes. The arcuate tubes are provided above the hinge. In this manner a ratchet-like opening is provided.

Four primary legs are provided. The primary legs are pivotally secured to the primary face adjacent to its corners between the primary peripheral side wall. Two secondary legs are provided. The secondary legs are pivotally secured to the secondary face adjacent to its exterior edge between the secondary peripheral side wall. The legs are pivotable between a collapsed orientation and a deployed orientation. In the collapsed orientation the legs are provided parallel with and adjacent to the primary and secondary faces entirely between the primary, and secondary peripheral side walls. In the deployed orientation the legs are provided perpendicular to the primary and exterior faces. The primary legs are positionable within a bathtub when in the deployed orientation during use with the secondary legs positioned outside of the bathtub. Each of the legs has an elastomeric cap. Each of the legs has a first spring ball. Each of the legs has aligned holes. In this manner the length of the legs may be adjusted. The distance between the interior and exterior edges of the primary section is greater than twice the length of each primary leg.

Provided next are water draining apertures. The water draining apertures are provided in the primary face. An elongated recess is provided. The elongated recess is provided along the rear edge of the primary face. A back support is provided. The back support has a lower region. The lower region is positionable in the elongated recess. An upper region is provided. The upper region is provided above the lower region. In this manner a user is supported. Vertical rods are provided. The vertical rods couple the upper and lower regions. Each vertical rod has a second spring ball. Each vertical rod has aligned holes. In this manner the height of the vertical rods may be adjusted. The back support is adapted to be stored adjacent to the inner surface of the secondary section when in the collapsed orientation. A supplemental elongated recess is provided. The supplemental elongated recess is provided along the primary face. In this manner the supplemental elongated recess receives the lower region. Additional recesses are provided. The additional recess are provided in the primary face. In this manner the additional recesses removably receive articles. The articles include articles such as a bar of soap.

A supplemental recess is provided. The supplemental recess is provided along the exterior edge of the primary face. An arm support is provided. The arm support has a lower region 78. The lower region is positionable in the supplemental recess. An upper region is provided. The upper region is provided above the lower region. In this manner a user is supported. Vertical rods are provided. The vertical rods couple the upper and lower regions. Each vertical rod has a third spring ball. Each vertical rod has aligned holes. In this manner the height of the vertical rod may be adjusted. The arm support is adapted to be stored adjacent to the inner surface of the primary section when in the collapsed orientation. Spring urged retainers are provided. The spring urged retainers are provided on the inner surfaces of the primary and secondary faces. In this manner the back and arm supports and legs are removably retained in a collapsed orientation.

Provided next are rectangular holes. The rectangular holes are provided in the primary and secondary peripheral side walls adjacent to the exterior edges of the primary and secondary peripheral side walls. Handles are provided. The handles have posts. The posts are reciprocally received within the rectangular holes. Each of the handles has a grip. The grip couples the posts. In this manner the posts may be carried when in the collapsed orientation.

Further provided is a locking pin. The locking pin extends outwardly from the peripheral side wall of the exterior edge of the primary section. A hook-shaped latch is provided. The hook-shaped latch is pivotally secured to the secondary peripheral side wall. The latch is adapted to couple and uncouple with respect to the locking pin.

Provided last is a belt. The belt is removably attached to the back support. In this manner the user is removably retaining to the primary section and the back support in a safe manner.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Shower/bath seat assembly which has all of the advantages of the prior art shower support systems of known designs and configurations and none of the disadvantages.

It is another object of the present invention to provide a new and improved Shower/bath seat assembly which may be easily and efficiently manufactured and marketed.

It is further object of the present invention to provide a new and improved Shower/bath seat assembly which is of durable and reliable constructions.

An even further object of the present invention is to provide a new and improved Shower/bath seat assembly which is susceptible of a low cost of manufacture with regard to both materials and labor, and which accordingly is then susceptible of low prices of sale to the consuming public, thereby making such Shower/bath seat assembly economically available to the buying public.

Even still another object of the present invention is to provide a Shower/bath seat assembly for converting between a deployed orientation for use and a collapsed orientation for storage, the converting being done in a safe, convenient and economical manner.

Lastly, it is an object of the present invention to provide a new and improved Shower/bath seat assembly. A seat assembly includes primary and secondary sections. Each section has a primary face and a secondary face. Each face has a peripheral side wall, interior and exterior edges, and front and rear edges. A hinge couples the side walls of the sections at the interior edges. In this manner movement between deployed and collapsed orientations is allowed. Four primary legs are pivotally secured to the primary face between its peripheral side wall. Two secondary legs are pivotally secured to the secondary face adjacent to its exterior edge between its peripheral side wall. The legs are pivotable between the collapsed and deployed orientations perpendicular to the primary and exterior faces. Holes are provided in the peripheral side walls adjacent to the exterior edges. A handle has legs reciprocally received within the holes. The handle has a grip. The grip couples the legs for carrying purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is plan view of the system taken along line 3-3 of FIG. 1.

FIG. 4 is a rear elevational view taken along line 4-4 of FIG. 2.

FIG. 5 is a plan view of the system in a partially collapsed orientation.

FIG. 5A is an exploded perspective of the hinge view of a portion of the hinge.

FIG. 6 is a plan view of the partially collapsed system taken along line 6-6 of FIG. 5.

FIG. 7 is an enlarged showing of one handle area taken at Circle 7 of FIG. 6.

FIG. 8 is cross sectional view taken along line 8-8 of FIG. 7.

FIG. 9 is a an enlarged showing of the end of one of the legs taken at Circle 9 of FIG. 1.

FIG. 10 is an enlarged showing of the lock for the sections of the seat assembly.

The same reference numerals refer to the same parts throughout the various Figures.

DESCRIPTION OF THE PREFERRED EMBODIMENT

Figure 1:
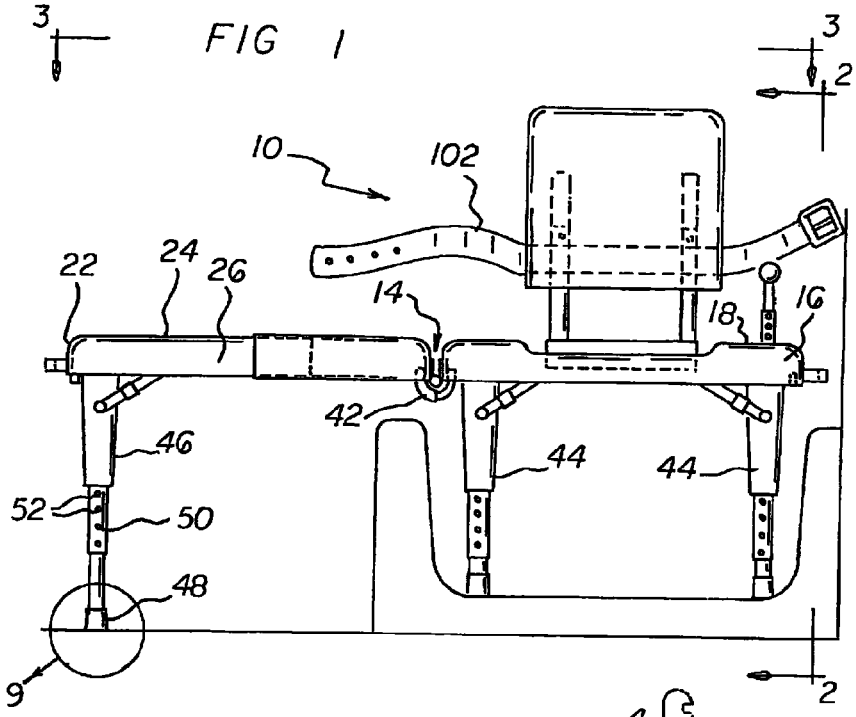
FIG. 1 is a front elevational view of a shower/bath seat system constructed in accordance with the principles of the present invention.

With reference now to the drawings, and in particular to FIG. 1 thereof, the preferred embodiment of the new and improved Shower/bath seat assembly embodying the principles and concepts of the present invention and generally designated by the reference numeral 10 will be described.

The present invention, the Shower/bath seat assembly 10 is comprised of a plurality of components. Such components in their broadest context include a seat assembly, four primary legs, holes and handle. Such components are individually configured and correlated with respect to each other so as to attain the desired objective.

First provided is a seat assembly 14. The seat assembly includes a generally rectilinear primary section 16. The primary section has a primary face 18. The primary section has a primary peripheral side wall 20. The seat assembly also includes a generally rectilinear secondary section 22. The secondary section has a secondary face 24. The secondary section has a secondary peripheral side wall 26. The secondary face and the secondary side wall are adapted to telescopically stretch and reduce in size. The primary and secondary faces each have an inner surface and an outer surface. Each primary and secondary face is rectangular. Each primary and secondary face has four corners. Each primary and secondary face has interior edges 28. Each primary and secondary face has exterior edges 30. Each primary and secondary face has front edges 32. Each primary and secondary face also has rear edges 34. The seat assembly includes a linear hinge 36. The linear hinge couples the primary and secondary side walls at the interior edges. In this manner movement is allowed between the deployed orientation and the collapsed orientation. In the deployed orientation the primary and secondary faces are in an essentially common plane. In the collapsed orientation the primary and secondary faces are in a spaced relationship and the peripheral side walls are in facing contact. In this manner a chamber is formed between the primary and secondary faces. The hinge has P-shaped sections 38. The P-shaped sections are secured to one of the primary or secondary peripheral side walls. The seat assembly also includes a linear rod 40. The linear rod pivotally supports the P-shaped sections. The hinge is restricted to a 90 degree open position. In this manner the primary and secondary faces are in an essentially common plane. The seat assembly further includes arcuate tubes 42. The arcuate tubes are provided above the hinge. In this manner a ratchet-like opening is provided.

Four primary legs 44 are provided. The primary legs are pivotally secured to the primary face adjacent to its corners between the primary peripheral side wall. Two secondary legs 46 are provided. The secondary legs are pivotally secured to the secondary face adjacent to its exterior edge between the secondary peripheral side wall. The legs are pivotable between a collapsed orientation and a deployed orientation. In the collapsed orientation the legs are provided parallel with and adjacent to the primary and secondary faces entirely between the primary and secondary peripheral side walls. In the deployed orientation the legs are provided perpendicular to the primary and exterior faces. The primary legs are positionable within a bathtub when in the deployed orientation during use with the secondary legs positioned outside of the bathtub. Each of the legs has an elastomeric cap 48. Each of the legs has a first spring ball 50. Each of the legs has aligned holes 52. In this manner the length of the legs may be adjusted. The distance between the interior and exterior edges of the primary section is greater than twice the length of each primary leg.

Provided next are water draining apertures 54. The water draining apertures are provided in the primary face. An elongated recess 56 is provided. The elongated recess is provided along the rear edge of the primary face. A back support 58 is provided. The back support has a lower region 60. The lower region is positionable in the elongated recess. An upper region 62 is provided. The upper region is provided above the lower region. In this manner a user is supported. Vertical rods 64 are provided. The vertical rods couple the upper and lower regions. Each vertical rod has a second spring ball 66. Each vertical rod has aligned holes 68. In this manner the height of the vertical rods may be adjusted. The back support is adapted to be stored adjacent to the inner surface of the secondary section when in the collapsed orientation. A supplemental elongated recess 70 is provided. The supplemental elongated recess is provided along the primary face. In this manner the supplemental elongated recess receives the lower region. Additional recesses 72 are provided. The additional recess are provided in the primary face. In this manner the additional recesses removably receive articles. The articles include articles such as a bar of soap.

A supplemental recess 74 is provided. The supplemental recess is provided along the exterior edge of the primary face. An arm support 76 is provided. The arm support has a lower region 78. The lower region is positionable in the supplemental recess. An upper region 80 is provided. The upper region is provided above the lower region. In this manner a user is supported. Vertical rods 82 are provided. The vertical rods couple the upper and lower regions. Each vertical rod has a third spring ball 84. Each vertical rod has aligned holes 86. In this manner the height of the vertical rod may be adjusted. The arm support is adapted to be stored adjacent to the inner surface of the primary section when in the collapsed orientation. Spring urged retainers 88 are provided. The spring urged retainers are provided on the inner surfaces of the primary and secondary faces. In this manner the back and arm supports and legs are removably retained in a collapsed orientation.

Provided next are rectangular holes 90. The rectangular holes are provided in the primary and secondary peripheral side walls adjacent to the exterior edges of the primary and secondary peripheral side walls. Handles 92 are provided. The handles have posts 94. The posts are reciprocally received within the rectangular holes. Each of the handles has a grip 96. The grip couples the posts. In this manner the posts may be carried when in the collapsed orientation.

Further provided is a locking pin 98. The locking pin extends outwardly from the peripheral side wall of the exterior edge of the primary section. A hook-shaped latch 100 is provided. The hook-shaped latch is pivotally secured to the secondary peripheral side wall. The latch is adapted to couple and uncouple with respect to the locking pin.

Provided last is a belt 102. The belt is removably attached to the back support. In this manner the user is removably retaining to the primary section and the back support in a safe manner.

Figure 2:
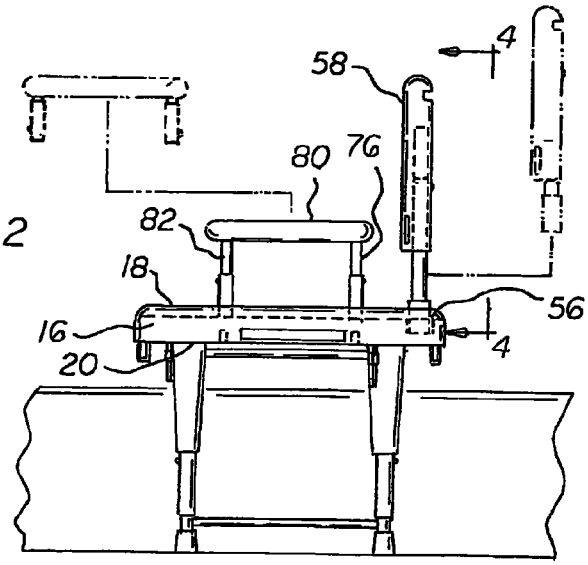
FIG. 2 is a side elevational view of the system taken along line 2-2 of FIG. 1.

The present invention allows for the simple and rapid conversion of a shower/bath seat system between an operative orientation deployed for use and an inoperative orientation contracted for storage and transportation. When in the operative orientation, the system is preferably deployed partially within a shower/bath tub ready for use as a shower/bath seat for cleaning a user sitting on the bench. Note FIGS. 1 and 2. When in the inoperative orientation, the system is contracted by folding into a suitcase with all of the components within the sections of the suitcase ready for being held by the handles for storage and transportation. Note FIGS. 5A and 10. When in the inoperative orientation, the system is light weight and small to facilitate lifting and moving. The light weight of the system also facilitates lifting and moving when in the orientation deployed for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower/bath seat system convertible between a deployed orientation for use and a collapsed orientation for storage, the system comprising, in combination:

a seat assembly including a generally rectilinear primary section having a primary face and a primary peripheral side wall, the seat assembly also including a generally rectilinear secondary section having a secondary face and a secondary peripheral side wall, the secondary face and the secondary peripheral side wall adapted to telescopically stretch and reduce in size, the primary and secondary faces each having an inner surface and an outer surface, said each primary and secondary face being rectangular with four corners and with interior edges and exterior edges and front edges and rear edges, a linear hinge coupling the primary and secondary side walls at the interior edges for allowing movement between the deployed orientation with the primary and secondary faces in an essentially common plane and the collapsed orientation with the primary and secondary faces in spaced relationship and with the peripheral side walls in facing contact to form an entirely enclosed chamber between the primary and secondary faces, the hinge being formed of P-shaped sections secured to one of the primary or secondary peripheral side walls, a linear rod pivotally supporting the P-shaped sections, the hinge being restricted to a 90 degree open position whereby the primary and secondary faces are in an essentially common plane, arcuate tubes above the hinge for effecting a ratchet-like opening;

four primary legs pivotally secured to the primary face adjacent to its corners between the primary peripheral side wall, two secondary legs pivotally secured to the secondary face adjacent to said exterior edge between the secondary peripheral side wall, the legs being pivotable between a collapsed, orientation parallel with and adjacent to the primary and secondary faces entirely within the enclosed chamber between the primary and secondary peripheral side walls and a deployed orientation perpendicular to the primary and exterior faces, the primary legs being positionable within a bathtub when in the deployed orientation during use with the secondary legs positioned outside of the bathtub, each of the legs having an elastomeric cap, each of the legs having a first spring ball and aligned holes for length adjusting purposes, the distance between the interior and exterior edges of the primary section being greater than twice the length of each primary leg;

water draining apertures in the primary face and an elongated recess along the rear edge of the primary face, a back support having a lower region positionable in the elongated recess, an upper region there above for supporting a user, vertical rods coupling the upper and lower regions, said vertical rod having a second spring ball and aligned holes for height adjusting purposes, the back support adapted to be stored adjacent to the inner surface of the secondary section when in the collapsed orientation, a supplemental elongated recess along the primary face for receiving the lower region, additional recesses in the primary face for removably receiving articles such as a bar of soap;

a supplemental recess along the exterior edge of the primary face, an arm support having a lower region positionable in the supplemental recess, an upper region there above for supporting the user, vertical rods coupling the upper and lower regions, each said vertical rod having a third spring ball and aligned holes for height adjusting purposes, the arm support adapted to be stored adjacent to the inner surface of the primary section when in the collapsed orientation, spring urged retainers on the inner surfaces of the primary and secondary faces for removably retaining the back and arm supports and legs in a collapsed orientation;

side holes in the primary and secondary peripheral side walls adjacent to the exterior edges of the primary and secondary peripheral side walls, handles having posts reciprocally received within the side holes, said each of the handles having a grip coupling the posts for carrying purposes when in the collapsed orientation;

a locking pin extending outwardly from the peripheral side wall, of the exterior edge of the primary section and a hook-shaped latch pivotally secured to the secondary peripheral side wall, the latch adapted to couple and uncouple with respect to the locking pin; and a belt removably attached to the back support for removably retaining the user to the primary section and the back support in a safe manner.

* * * * *